US005178449A

United States Patent [19]

Bauer

[11] Patent Number: 5,178,449

[45] Date of Patent: Jan. 12, 1993

[54] LAMP ASSEMBLY

[76] Inventor: Ronald S. Bauer, 8532 Edwin Dr., Los Angeles, Calif. 90046

[21] Appl. No.: 883,675

[22] Filed: May 15, 1992

[51] Int. Cl.[5] ..... H01R 33/08

[52] U.S. Cl. ..... 362/133; 362/217; 362/277

[58] Field of Search ..... 362/217, 220, 240, 250, 362/133, 277

[56] References Cited

U.S. PATENT DOCUMENTS 2,800,573 7/1957 Hudson ..... 362/220
2,847,561 8/1958 Huerkamp et al. ..... 362/220
4,208,702 6/1980 Wotowiec ..... 362/220
4,739,454 4/1988 Federgreen ..... 362/217

*Primary Examiner*—James C. Yeung
*Attorney, Agent, or Firm*—Jack C. Munro

[57] ABSTRACT

A lamp assembly which utilizes as a source of light an elongated illumination tube. This tube is fixedly mounted within a carrier housing with this housing being pivotably mounted between a pair of mounting brackets which are utilized to fixedly mount the lamp assembly at any desired location on an exterior object.

5 Claims, 2 Drawing Sheets

LAMP ASSEMBLY

BACKGROUND OF THE INVENTION

1) Field of the Invention

The field of this invention relates generally to lighting fixtures and more particularly to an illumination tube which can be quickly and easily mounted at any desired location on an exterior object and this tube being adjustable to assume various angles of illumination.

2) Description of the Prior Art

Lamp assemblies are exceedingly common and are in widespread usage. One type of lighting fixture that has been used in the past is a lighting fixture which utilizes a long, thin light bulb in which is to be located within an unusual or confining installing location such as under a shelf, at the top edge of a picture frame or other similar type of installation. The reason these types of lighting fixtures have been found to be so useful is that the occupy a small amount of space, generally do not affect the appearance of the object on which such are mounted and in some instances can be completely hidden from view. These types of fixtures can be utilized as a form of direct lighting or can be utilized as indirect lighting.

SUMMARY OF THE INVENTION

The structure of the present invention is directed to a lamp assembly which utilizes an elongated cylindrical illumination tube which is to be operated electrically by electrical wires which are connected to the tube. This tube is fixedly mounted within a carrier U-shaped housing with a portion of the housing extending beyond the end of each tube. Within the portion of the housing that extends beyond the end of each tube is mounted a block with each block being fixedly mounted within its respective end. Each block is pivotally mounted onto a cylindrical protrusion of a mounting bracket with it being understood that there are two in number of mounting brackets. Each block is readily pivotable on its mounting bracket so that the illumination tube and its carrier housing can be pivoted to assume various angles of inclination relative to the brackets. These brackets are to be fixedly mounted by some conventional fixing means such as an adhesive or a screw fastener at a desired location on an exterior structure. The leg of each mounting bracket is recessed so as to provide adequate clearance in the pivoting of the housing.

The primary object of the present invention is to provide a lamp assembly which can be readily and quickly installed underneath shelves and other normally inaccessible locations which is to provide an indirect (or even direct) lighting.

Another objective of the present invention is to construct a lamp assembly which is easily and quickly adjustable to vary the direction or angle of illumination the lamp assembly provides.

Another objective of the present invention is to construct a lamp assembly which is convenient to use, reliable in usage and relatively inexpensive to manufacture and sell to the ultimate user.

DETAILED DESCRIPTION OF THE SHOWN EMBODIMENT

Figures 1, 2, 3, 4, 5:
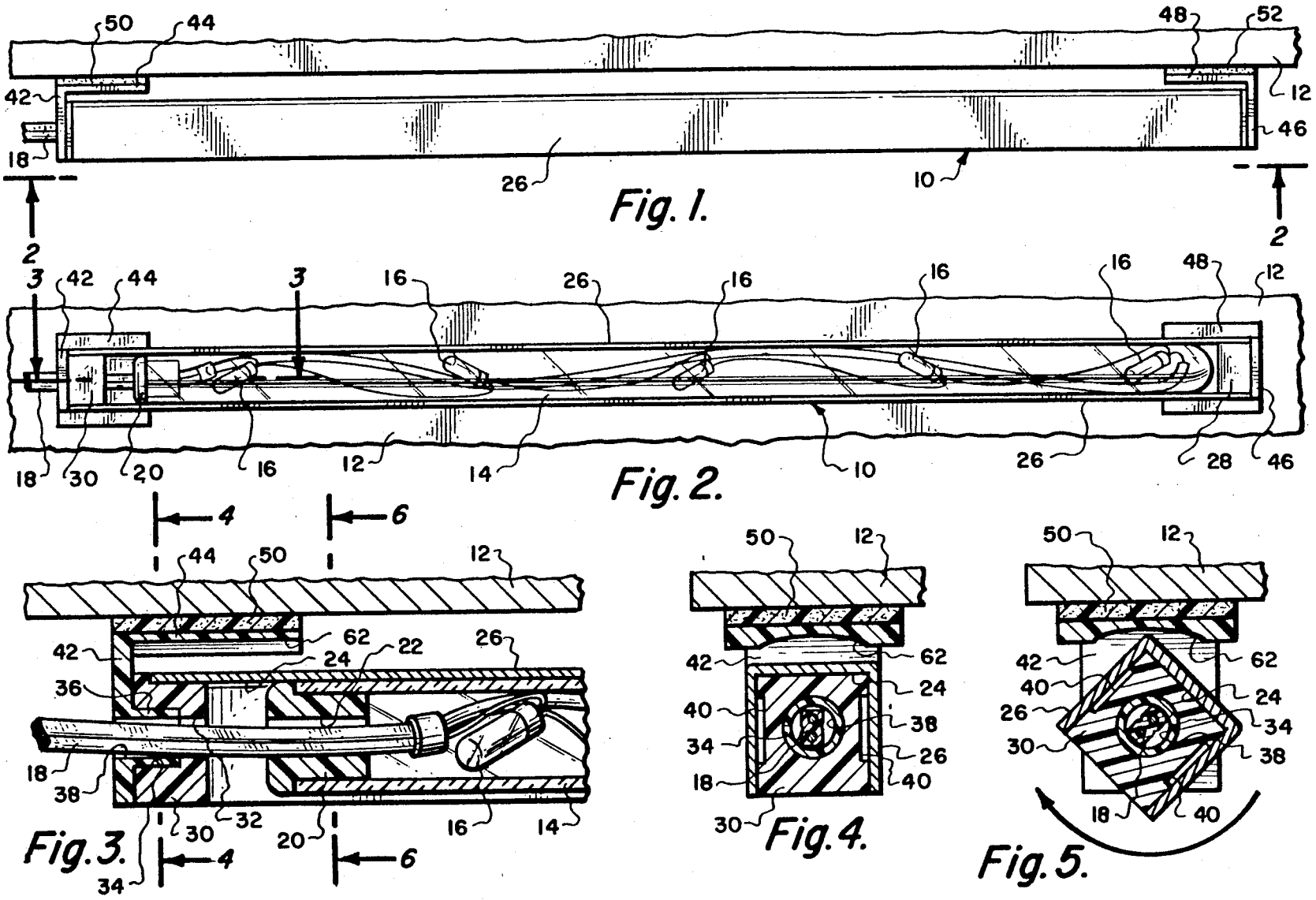
FIG. 1 is a longitudinal front view of the lamp assembly of the present invention.
FIG. 2 is a bottom view of the lamp assembly of the present invention taken along line 2—2 of FIG. 1.
FIG. 3 is a cross-sectional view through a portion of the lamp assembly of the present invention taken along line 3—3 of FIG. 2.
FIG. 4 is a transverse cross-sectional view through one of the mounting brackets utilized in conjunction with the lamp assembly of the present invention taken along line 4—4 of FIG. 3.
FIG. 5 is a view similar to FIG. 4 but showing the illumination tube and its carrier housing position at a different angle of inclination than in FIG. 4.
Figure 6:
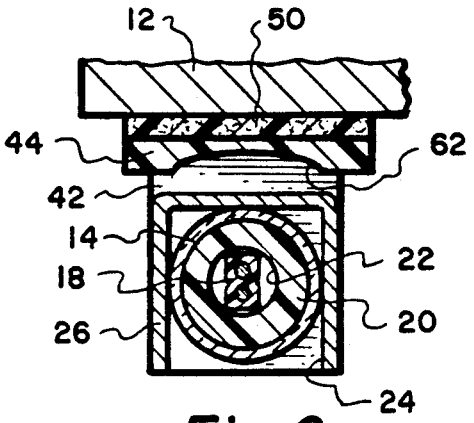
FIG. 6 is a transverse cross-sectional view through the illumination tube of the lamp assembly of the present invention taken along line 6—6 of FIG. 3.

Referring particularly to the drawings, there is shown the lamp assembly 10 of this invention which is designed to be mounted on an exterior structure such as underneath a shelf 12. Shelf 12 can be any rigid material such as wood, steel or plastic. It is to be understood that numerous other mounting environments can be utilized other than the shelf 12.

A light bulb in the form of a plastic illumination tube 14, which is cylindrical, is utilized within which is mounted a plurality of spaced apart light bulbs 16. Again, any form of a light bulb arrangement could be utilized without departing from the scope of this invention. The light bulbs 16 are connected together electrically in series with electrical conductor 18 connecting the light bulbs 16 to a source of electricity (not shown). The outer end of the tube 14 is integrally closed with the inner end of the tube 14 being closed by a plug 20. This plug 20 includes a through opening 22 and it is within this through opening 22 that the wires 18 pass.

The illumination tube 14 is snugly retained within an internal chamber 24 of a U-shaped housing 26 which functions as a carrier for the illumination tube 14. The housing 26 permits the light that is illuminated from the tube 14 to be directed in only one direction and that is through the open end of the housing 26. The housing 26 will be constructed to be opaque. A preferable material of construction for the housing 26 would be either plastic or metal. The tube 14 is snugly retained in a press fitted arrangement within the internal chamber 24 and it is noted that a portion of the housing 26 extends beyond each end of the tube 14.

Within the internal chamber 24 of the housing 26 that extends beyond the closed end of the tube 14, there is mounted a square-shaped block 28. Typical material of construction of this block 28 would be plastic. This block 28 is snugly retained within the housing 26. At the opposite end of the housing 26 there is fixedly mounted a block 30 within the internal chamber 24 of the housing 26.

The block 30 includes a through hole 32. The block 28 has no need for such a hole 32 but may include such in order to minimize the manufacturing of different parts. The block 30 includes an enlarged through hole 34 which connects with the through hole 32. Enlarged through hole 34 is to be snugly mounted on a cylindrical protrusion 36. However, the block 30 is to be pivotable on the protrusion 36. It is to be understood that a similar protrusion type of mounting will occur for block 28, again pivoting being permitted. The protrusion 36 includes a through opening 38 and it is through this through opening 38 that the conducting wires 18 is permitted to pass therethrough. A protrusion (not shown) utilized in conjunction with block 28 would have no need for the through hole 38 but again might include such in order to minimize the manufacturing of different parts.

The block 30 has sidewalls within which are located recesses 40. It is the function of the recesses 40 to provide a certain amount of "give" permitting the block 30 to deflect slightly when being installed within the internal chamber 24 of the housing 26. During this installation it is to be understood that the housing 26 will also deflect in a slightly outward direction. When block 30, as well as block 28, is fully installed in position, there is a inherently created biasing action between the housing 26 and each of the blocks 28 and 30 so as to snugly hold such in position.

Figure 8:
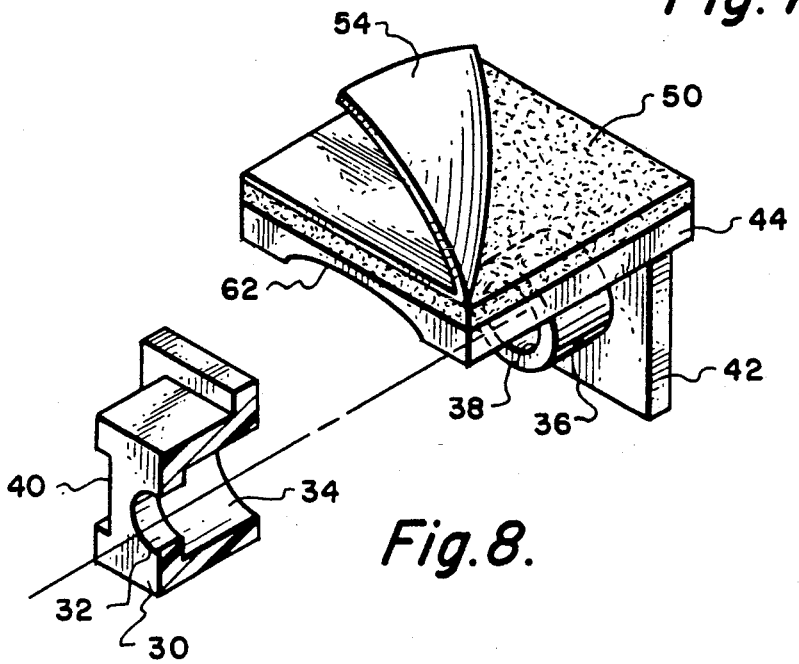
FIG. 8 is an exploded view, partly in cross section, of a mounting bracket which is utilized in conjunction with the lamp assembly of the present invention where the mounting bracket uses adhesive as securement to an exterior structure.
Figure 9:
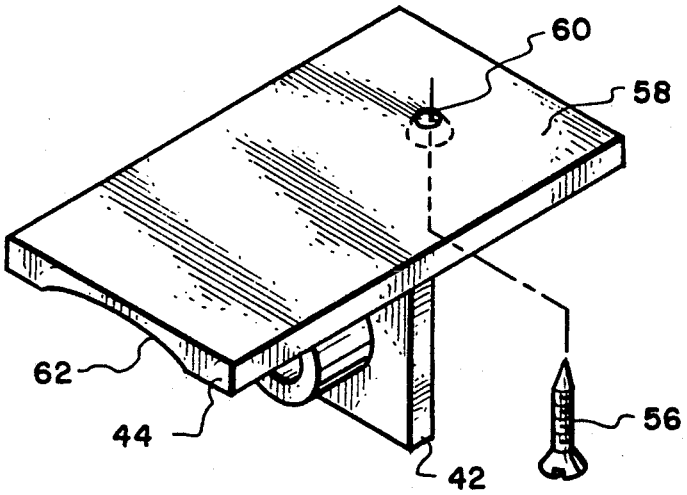
FIG. 9 is a view similar to FIG. 8 of a portion of the mounting bracket showing a screw fastener type of a securement as opposed to the adhesive type of securement.

The protrusion 36 is integrally mounted on leg 42 of an L-shaped mounting bracket which includes an upper leg 44. It is also to be understood that the protrusion associated with the block 28 is integrally mounted on leg 46 of an L-shaped mounting bracket which includes an upper leg 48. The L-shaped mounting bracket composed of a legs 46 and 48 is essentially identical in construction to the L-shaped mounting bracket which comprises legs 42 and 44. The legs 44 and 48 are mounted in a facing relationship in respect to each other and in alignment. On the outer surface of the legs 44 and 48 there is included some form of securement. One type of securement as is shown in FIG. 8 and comprises an adhesive pad 50. A similar adhesive pad 52 is mounted on the leg 48. A release paper 54 is to be removed to expose the adhesive pad 50 so that it can be secured to an exterior structure such as the shelf 12. Once the adhesive pads 50 and 52 are so installed, the lamp assembly 10 is now supportingly held in the desired position and is ready to be used. If it is desired that the adhesive pads 50 and 52 are not to be used, instead there could be utilized a screw fastener 56 as shown in FIG. 9. In such an instance, the upper leg 44, as well as upper leg 48, would be extended to include a back extension 58. It is within the back extension 58 that there would be provided a screw hole 60 through which the screw 56 would be conducted and permitted to penetrate the exterior structure such as the shelf 12.

Figure 7:
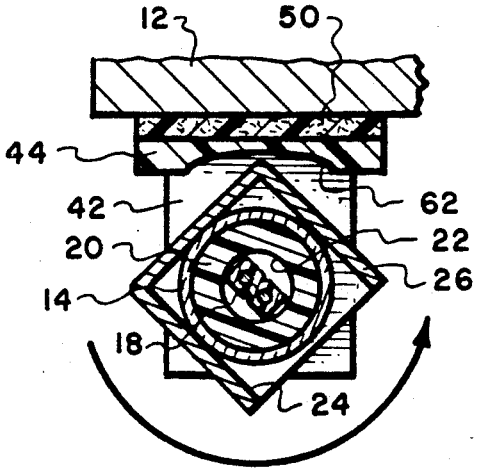
FIG. 7 is a view similar to FIG. 6 but showing the illumination tube and its carrier housing located in a different angle of inclination than that shown in FIG. 6.

As previously mentioned, the housing 26 is to be pivotable relative to both protrusions such as protrusion 36. This pivoting is readily depicted in both FIGS. 5 and 7 of the drawings. This pivoting is so as to direct the light being produced from the illumination tube 14 toward a particular direction. Once a particular position is obtained, the housing 26 will remain in that position.

Because of the corners of the square shaped housing 26, the inner surface of the upper legs 44 and 48 may interfere with this pivoting action. In order to provide sufficient clearance for such pivoting, the upper legs 44 and 48 are inwardly contoured to form recess 62.

What is claimed is:

1. A lamp assembly adapted for mounting on an exterior object such as underneath a shelf, said lamp assembly comprising:

an elongated illumination tube terminating in a pair of ends, an elongated U-shaped housing having an internal chamber, a light bulb being fixedly mounted within said tube, said elongated illumination tube being fixedly mounted to said housing and located within said internal chamber, a portion of said housing protruding beyond each said end forming a pair of block receiving chambers;

a block fixedly mounted in each said block receiving chamber, each said block having a central enlarged opening; and said central enlarged opening being pivotally mounted on a cylindrical protrusion of a mounting bracket, each said mounting bracket being L-shaped forming an attaching leg, means connecting with said attaching leg for securement to the exterior object, whereby after securement to the exterior object said housing being manually pivotable about both said brackets to any one of a variety of positions and once pivoted to a particular position said housing will remain in that position.

2. The lamp assembly as defined in claim 1 wherein:

said attaching legs of both said mounting brackets being located in a facing relationship and directly adjacent a portion of said housing, each said attaching leg having an exterior surface located directly adjacent said housing, each said attaching leg being recessed to define clearance to not interfere with said housing as it is pivoted relative to said mounting brackets.

3. The lamp assembly as defined in claim 2 wherein:

said cylindrical protrusion including a through hole, electrical conducting wires being conductable through said through hole to connect with said light bulb.

4. The lamp assembly as defined in claim 4 wherein:

said means comprising an adhesive.

5. The lamp assembly as defined in claim 4 wherein:

said means comprising a screw fastener.

* * * * *